United States Patent [19]

Obana

[11] Patent Number: 4,970,555

[45] Date of Patent: Nov. 13, 1990

[54] IMAGE FORMING APPARATUS

[75] Inventor: Shigenori Obana, Yokohama, Japan

[73] Assignee: Kabushiki Kaisha Toshiba, Kawasaki, Japan

[21] Appl. No.: 315,803

[22] Filed: Feb. 27, 1989

[30] Foreign Application Priority Data

Mar. 4, 1988 [JP] Japan ..... 63-49752

[51] Int. Cl.[5] ..... G03G 21/00

[52] U.S. Cl. ..... 355/207; 355/316; 355/318

[58] Field of Search ..... 355/316, 318, 319, 207

[56] References Cited

U.S. PATENT DOCUMENTS 4,497,569 2/1985 Booth, Sr. .
4,693,586 9/1987 Sumida et al. ..... 355/319
4,835,567 5/1989 Ogata ..... 355/318

FOREIGN PATENT DOCUMENTS 0219244 4/1987 European Pat. Off. .
0225546 6/1987 European Pat. Off. .
626269 7/1985 Japan .

*Primary Examiner*—A. T. Grimley
*Assistant Examiner*—Sandra L. Hoffman
*Attorney, Agent, or Firm*—Foley & Lardner, Schwartz, Jeffery, Schwaab, Mack, Blumental & Evans

[57] ABSTRACT

An image forming apparatus includes an image forming section for forming an image on a sheet, a main convey mechanism for delivering the sheet to outside the image forming apparatus through the image forming section, and a reconvey mechanism for separating the sheet from the main convey mechanism at the downstream side of the image forming section, and merging the separated sheet to the upstream side of the image forming section. The reconvey mechanism has a gate for separating the sheet from the main convey mechanism to the reconvey mechanism, and a detector for detecting the jam of the sheet in the reconvey mechanism. The image forming apparatus also includes a control circuit and the like for preventing the separation of the sheet by the gate, and then delivering the sheet following the jammed sheet to outside the image forming apparatus.

8 Claims, 4 Drawing Sheets

IMAGE FORMING APPARATUS

BACKGROUND OF THE INVENTION

1. Field of the Invention

The present invention relates to an image forming apparatus such as an electronic copying machine.

2. Description of the Related Art

A conventional electronic copying machine which can perform multiple and both-side image formation is generally known. This copying machine has a main convey mechanism and a reconvey mechanism. The main convey mechanism is used to convey a sheet fed from a sheet feed section to a sheet delivery section through a transfer section disposed between a photosensitive drum and a transfer charger and a fixing unit in the order named. The reconvey mechanism is used to separate a sheet conveyed by the main convey mechanism from its path by a gate between the fixing unit and the sheet delivery section, and refeed the separated sheet to a portion between the feed section and the transfer section through a stack section. During multiple or both-side image formation, a sheet is fed again to the transfer section by the reconvey mechanism.

In such a conventional apparatus, when a sheet is jammed between the gate and the stack section, copying operation is temporarily stopped and the jammed sheet is removed. For this reason, a copying operation cannot be performed until the jammed sheet is removed, resulting in time-consuming operation.

SUMMARY OF THE INVENTION

It is an object of the present invention to provide an image forming apparatus which can deliver a sheet while an image forming operation continues, continued without waiting until a jammed sheet is removed, even if the sheet is jammed between a separating means and a stack section.

According to one aspect of the present invention, there is provided an image forming apparatus which includes an image forming means for forming an image on a sheet;

main conveying means for delivering the sheet to outside the image forming apparatus through the image forming means;

reconveying means for separating the sheet from the main conveying means at the downstream side of the image forming means, and merging the separated sheet to the upstream side of the image forming means, the reconveying means being provided with separating means for separating the sheet from the main conveying means to the reconveying means, and, detecting means for detecting a feeding sheet problem in the reconveying means; and means for delivering one or more sheets following the delivery trouble of the sheet to outside the image forming apparatus when the detecting means detects the delivery trouble of the sheet.

DETAILED DESCRIPTION OF THE PREFERRED EMBODIMENT

An embodiment of the present invention will be described below with reference to the accompanying drawings.

Figure 1:
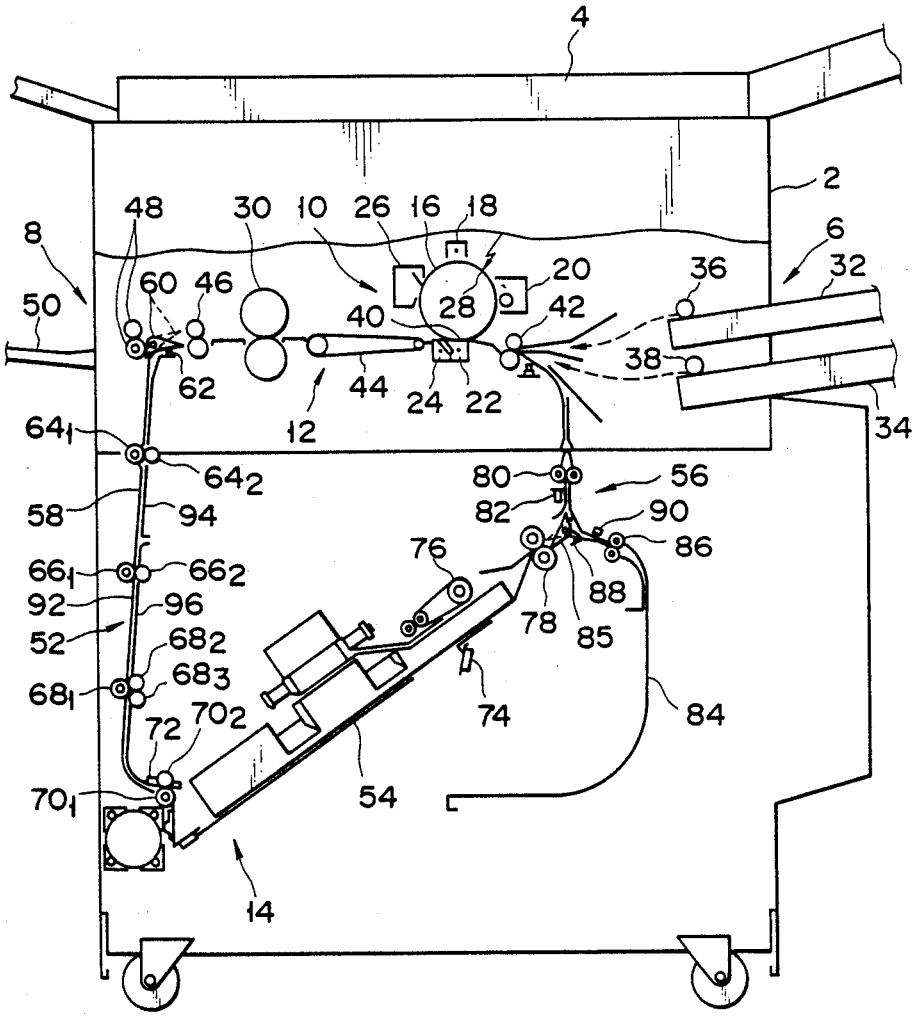
FIG. 1 is a perspective view showing an embodiment of an electronic copying machine serving as an image forming apparatus according to the present invention.

In FIG. 1, reference numeral 2 denotes a housing of an electronic copying machine serving as an image forming apparatus according to the present invention. An original table (not shown) made of a transparent glass is disposed on the upper surface of the housing 2. An automatic sheet feeder 4 for automatically setting an original on the original table is arranged on the upper portion of the housing 2 so as to cover the original table. Sheet feed and delivery sections 6 and 8 are respectively disposed in the right and left side portions of the housing 2.

The housing 2 includes an image forming section 10 for forming an image corresponding to image data of an original on the original table, a main convey mechanism 12 for conveying a sheet fed from the sheet feed section 6 to the sheet delivery section 8 through the image forming section 10, and a reconvey mechanism 14 for refeeding the sheet on which an image is formed by the image forming section 10 to the image forming section 10.

The image forming section 10 has a photosensitive drum 16 rotatably supported in the housing 2. Around the photosensitive drum 16, a charger 18, a developing unit 20, a transfer charger 22, a separating charger 24, and a cleaning unit 26 are disposed along a rotating direction of the photosensitive drum 16, in the order named. The charger 18 is used to uniformly charge the surface of the photosensitive drum 16. An exposure position 28 in an exposure unit (not shown) is set between the charger 18 and the developing unit 20 around the photosensitive drum 16. The exposure unit is used to illuminate the original set on the original table, to guide its reflected light to the exposure position 28 on the surface of the photosensitive drum 16 and to expose the surface of the photosensitive drum 16, thus forming an electrostatic latent image on the surface of the photosensitive drum 16. The developing unit 20 is used to supply a toner to the electrostatic latent image and form a toner image on the photosensitive drum 16. The transfer charger 22 is used to transfer the toner image carried on the photosensitive drum 16 onto the sheet. The separating charger 24 is used to separate, from the photosensitive drum 16, the sheet electrostatically attracted thereto. The cleaning unit 26 is used to remove the toner, which remains on the photosensitive drum 16 without transferring on the sheet, from the photosensitive drum 16.

The image forming section 10 also has a fixing unit 30. The fixing unit 30 is used to fix a toner image on the sheet on which the toner image is transferred.

The sheet feed section 6 has upper and lower sheet cassettes 32 and 34 for storing sheets, and upper and lower pickup rollers 36 and 38 for picking up the sheets from these sheet cassettes 32 and 34.

The main convey mechanism 12 has a pair of first aligning rollers 42 for aligning the sheet fed from the sheet feed section 6 and conveying the aligned sheet to a transfer section 40 between the photosensitive drum 16 and the transfer charger 22, a conveyor belt 44 for conveying the sheet separated from the photosensitive drum 16 by the transfer charger 22 to the fixing unit 30, and a pair of convey rollers 46 for conveying the sheet on which a toner image is fixed by the fixing unit 30 to the sheet delivery section 8.

The sheet delivery section 8 has a pair of sheet delivery rollers 48 for delivering the sheet conveyed by the convey rollers 46 to outside the housing 2, and a sheet delivery tray 50 for receiving the sheet delivered by the sheet delivery rollers 48.

The reconvey mechanism 14 has a turn guide mechanism 52 for separating the sheet conveyed by the main convey mechanism 12 from its path at the position between the convey and sheet delivery rollers 46 and 48 and then turning it, a stack section 54 for stacking the sheet turned by the turn guide mechanism 52, and a refeed mechanism 56 for refeeding the sheet stacked in the stack section 54 to the transfer section 40.

The turn guide mechanism 52 has a turn guide 58 for guiding the sheet from the position between the convey and sheet delivery rollers 46 and 48 downward, a first gate 60 for selectively guiding the sheets conveyed from the convey rollers 46 to the sheet delivery rollers 48 or to the turn guide 58, a first gate detector 62 arranged near the first gate 60, for detecting that the sheet passes through the first gate 60, two pairs of convey rollers $64_1$ and $64_2$, and $66_1$ and $66_2$ for conveying the sheet guided by the turn guide 58, curl correction rollers $68_1$, $68_2$, and $68_3$ for eliminating the curl of the sheet conveyed by the convey rollers $64_1$, $64_2$, $66_1$, end $66_2$, a pair of stack rollers $70_1$ and $70_2$ for conveying the sheet conveyed by the curl correction rollers $68_1$, $68_2$, and $68_3$ to the stack section 54, and a jam detector 72, arranged at the sheet inlet side between the stack rollers $70_1$ and $70_2$, for detecting the jam of the sheet in the turn guide mechanism 52.

The stack section 54 is disposed to be inclined. The stack rollers $70_1$ and $70_2$ are disposed to oppose the lower end side of the inclined stack section 54. A stack detector 74 is arranged at the stack section 54 to detect that the sheet is stacked.

The refeed mechanism 56 includes pickup rollers 76 for picking up the sheets stacked in the stack section 54 one by one, a pair of separating rollers 78 for separating the picked up sheets one by one, second aligning rollers 80 for aligning the separated sheet and conveying it to the first aligning rollers 42, a second gate detector 82 arranged near the second aligning rollers 80 to detect that the sheet passes therethrough, reverse guide 84 for turning over the sheet during a both-side copying operation, a second gate 85 for conveying the sheet conveyed from the separating rollers 78 to the second aligning rollers 80 during a multiple copying operation, and conveying the sheet to the reverse guide 84 during the both-side copying operation, reverse rollers 86, which can rotate in the correct and reverse directions, for guiding the sheet conveyed through the second gate 85 to the reverse guide 84, and thereafter delivering the sheet from its trailing end, during the both-side copying operation, a third gate 88 for guiding the sheet delivered by the reverse rollers 86 to the second aligning rollers 80, and a sheet reverse detector 90 arranged at a sheet inlet side of the reverse rollers 86 to detect that the sheet passes therethrough.

Figure 2:
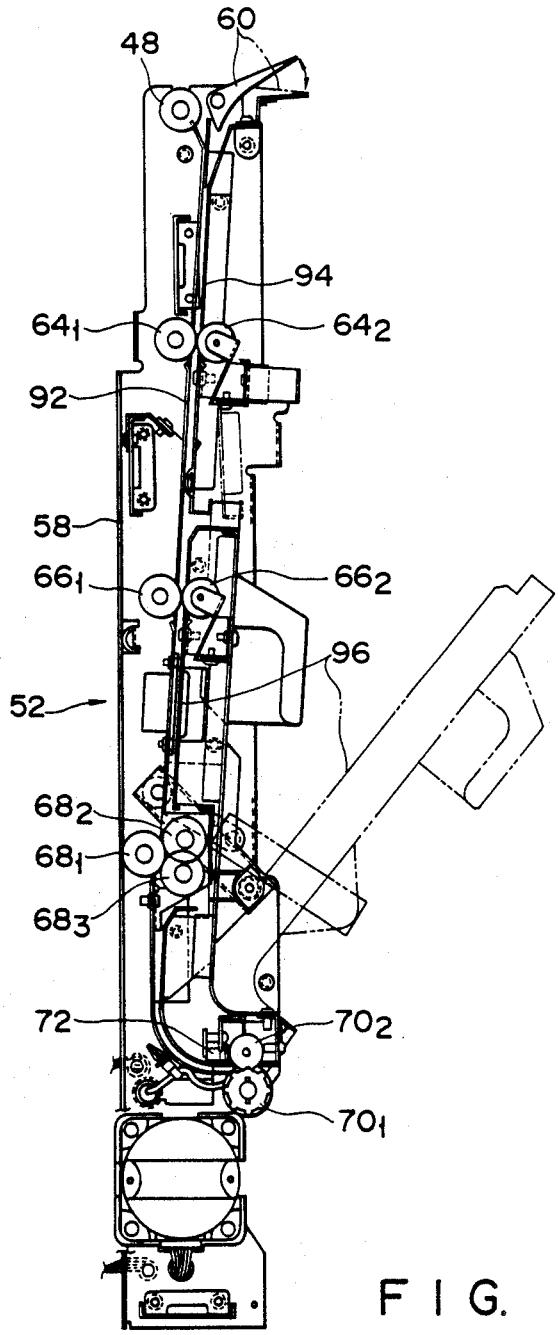
FIG. 2 is a view showing a part of a reconvey mechanism shown in FIG. 1.

As shown in FIG. 2, the turn guide 58 has first and second fixed guides 92 and 94, and a movable guide 96. The first fixed guide 92 is used to guide one surface of the sheet. The second fixed and movable guides 94 and 96 are used to guide the other surface of the sheet. One of the sheet delivery rollers 48, the convey rollers $64_1$, $64_2$, and $66_1$, the correction roller $68_1$, and the stack rollers $70_1$ and $70_2$ are supported by the fixed guides 92 and 94. The convey roller 662 and the correction rollers $68_2$ and $68_3$ are supported by the movable guide 96. The movable guide 96 is arranged pivotably at a predetermined angle about the rotating axis of the stack roller $70_2$, as represented by the imaginary line shown in FIG. 2. When the movable guide 96 is pivoted, the interval between the movable guide 96 and the first fixed guide 92, the interval between the convey rollers $66_1$ and $66_2$, and the interval between the correction rollers $68_1$, and $68_2$ and $68_3$ are opened.

Figure 3:
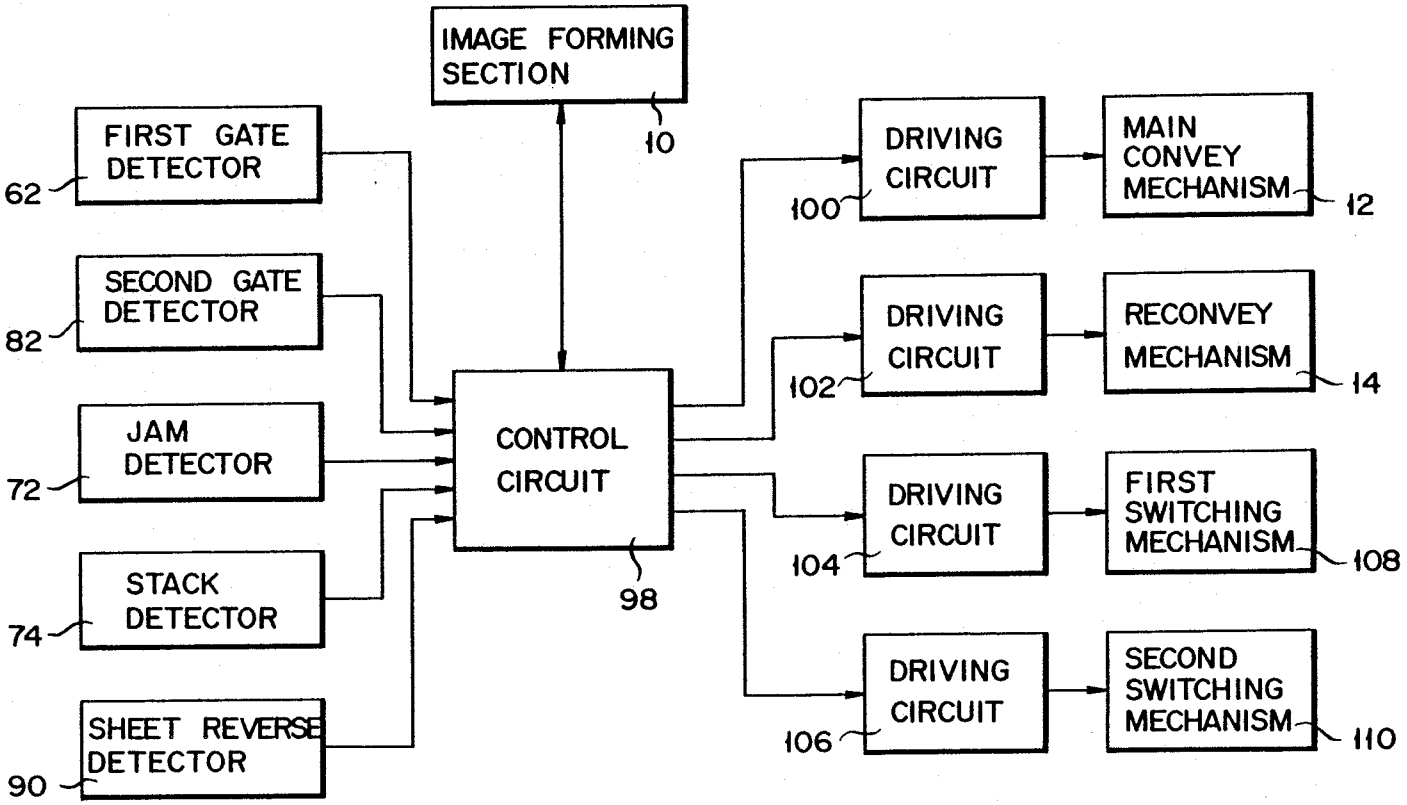
FIG. 3 is a block diagram showing a control system of the copying machine shown in FIG. 1.

FIG. 3 shows a control system of the copying machine. In FIG. 3, reference numeral 98 denotes a control circuit for controlling the entire copying machine. The control circuit 98 receives signals from the image forming section 10, the first gate detector 62, the second gate detector 82, the jam detector 72, the stack detector 74, and the sheet reverse detector 90. In addition, the control circuit 98 outputs control signals to the image forming section 10, and first to fourth driving circuits 100, 102, 104, and 106. The first driving circuit 100 drives the main convey mechanism 12 in response to the control signal. The second driving circuit 102 drives the reconvey mechanism 14 in response to the control signal. The third driving circuit 104 drives a first switching mechanism 108 for switching the first gate 60. The fourth driving circuit 106 drives a second gate switching mechanism 110 for switching the second and third gates 85 and 88. The first, second, and third gates 60, 85, and 88 are normally driven so that normal, multiple, and both-side copying operations to be described later are executed. However, when the jam detector 72 detects a jam of a sheet during the multiple or both-side copying operation, the first gate 60 is pivoted and displaced to the position for preventing the sheet conveyed by the main convey mechanism 12 from being guided to the reconvey mechanism 14, i.e., the position for guiding the sheet from the convey rollers 46 to the sheet delivery rollers 48.

In a normal copying operation, when a copying button on an operation panel (not shown) is depressed, first, the surface of the photosensitive drum 16 is uniformly charged by the charger 18. The reflected light from an original on the original table is guided to form an image by the exposure unit (not shown) on the surface of the photosensitive drum 16. Therefore, a latent electrostatic image is formed. This latent electrostatic image is developed by the developing unit 20. Therefore, a toner image is formed. On the other hand, a sheet is fed from the sheet cassette 32 or 34, and the fed sheet is aligned by the first aligning rollers 42. Thereafter, the aligned sheet is fed between the photosensitive drum 16 and the transfer charger 22. The toner image on the photosensitive drum 16 is transferred on one surface of the sheet by the transfer charger 22. The toner image is fixed to the sheet by the fixing unit 30. The sheet is delivered on the sheet delivery tray 50 through the convey rollers 46, the first gate 60, and the sheet delivery rollers 48, in the order named.

In multiple-copying operation, when the copying button on the operation panel is depressed, an image is formed on one surface of the sheet in the same manner as in the above operation. Thereafter, the sheet conveyed by the convey rollers 46 is guided by the first gate 60 to the stack rollers $70_1$ and $70_2$ through the turn guide 58. The sheet is stacked in the stack section 54 by the stack rollers $70_1$ and $70_2$ so that the surface on which the image is formed faces down. The required number of sheets are continuously stacked in the stack section 54. After the stack operation is completed, the next original is set. When the copying button is depressed, the pickup rollers 76 are moved downward onto the sheet stacked in the stack section 54, and hence the uppermost sheet is delivered. When two or more sheets are delivered, lower separating rollers 78 are rotated in the reverse direction, so that the lower sheet is returned to the stack section 54, thus conveying only the uppermost sheet. Thereafter, the pickup rollers 76 are moved upward, and the sheet is conveyed to the second aligning rollers 80 through the second gate 84. When the leading end of the sheet reaches the second aligning rollers 80, the sheet is aligned because the second aligning rollers 80 are stopped at this time. When the aligning operation is completed, the second aligning rollers 80 are rotated, so that the sheet is conveyed to the first aligning rollers 42. Then, an image is formed on the same surface of the sheet as the surface on which the previous image is formed to overlap the previous image. Thereafter, the sheet is delivered on the sheet delivery tray 50 through the convey rollers 46, the first gate 60, and the sheet delivery rollers 48. These operations are continued until all the sheets stacked in the stack section 54 are subjected to the multiple copying, and all the copied sheets are delivered.

In both-side copying operation, the same operations as in the multiple copying operation are performed until the sheet passes through the separating rollers 78. The sheet conveyed by the separating rollers 78 is conveyed to the reverse rollers 86 by the second gate 85 pivoted in the state represented by the imaginary line in FIG. 1. When the trailing end of the sheet passes through the reverse detector 90, the reverse rollers 86 are stopped, and the second gate 84 is returned to the original state represented by the solid line shown in FIG. 1. Thereafter, the reverse rollers 86 are rotated in the reverse direction, and hence the sheet is conveyed to the second aligning rollers 80 from the trailing end side. Therefore, the sheet is turned over. When the sheet reaches the second aligning rollers 80, the sheet is aligned because the second aligning rollers 86 are stopped. After the aligning operation is completed, when the second aligning rollers 80 are rotated, the sheet is conveyed to the first aligning rollers 42. Then, an image is formed on the rear surface of the sheet with respect to the surface on which the previous image is formed. Thereafter, the sheet is delivered on the sheet delivery tray 50 through the convey rollers 46, the first gate 60, and the sheet delivery rollers 48. These operations are continued until all the sheets stacked in the stack section 54 are subjected to the both-side copying, and all the copied sheets are delivered.

In the multiple or both-side copying operation, when a sheet is jammed in the turn guide mechanism 52, the jam detector 72 detects that the sheet is jammed. The detection signal from the detector 72 is supplied to the control circuit 98. The driving circuit 104 drives the first switching mechanism 108 in response to a signal from the control circuit 98. The first gate 60 is pivoted to the position represented by the solid line in FIG. 1. Therefore, the sheet following the jammed sheet is not guided to the turn guide mechanism 52 but is guided to the sheet delivery rollers 48 by the first gate 60, and is delivered on the sheet delivery tray 50.

Figure 4:
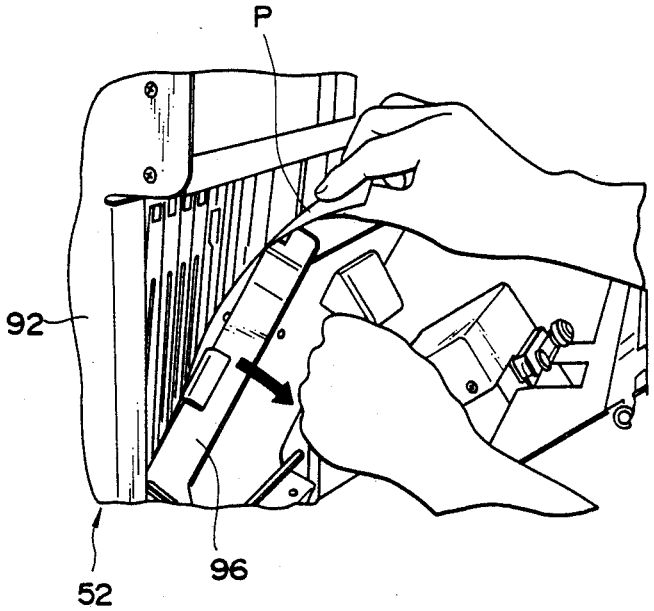
FIG. 4 is a view for explaining an operation in the reconvey mechanism shown in FIG. 3 when a sheet is jammed.

As shown in FIG. 4, a sheet p jammed in the turn guide mechanism 52 is removed by causing the movable guide 96 to pivot, and opening the interval between the first fixed guide 92 and the movable guide 94, the interval between the convey rollers $66_1$ and $66_2$, and the interval between the correction rollers $68_1$, $68_2$, and $68_3$.

As described above, when the sheet p is jammed in the turn guide mechanism 52, the first gate 60 is caused to pivot and displace and the following sheet p is delivered on the sheet delivery tray 50. Therefore, the jammed sheet can be removed while the copying operation is continued, thus reducing time-consumption.

When a sheet is jammed, the loss of copied sheets can be compensated by copying about one or two more sheets.

What is claimed is:

1. An image forming apparatus comprising:

means for forming an image on a sheet, said image forming means having means for selectively performing multiple image formation or both-side image formation;

main conveying means for conveying one or more sheets through the image forming means to the outside of said image forming apparatus;

reconveying means for separating the sheets from said main conveying means at the downstream side of said image forming means and conveying the separated sheets tot he upstream side of said image forming means, so as to perform either multiple or both-side image formation, said reconveying means having detecting means for detecting trouble or a malfunction in the feeding of the sheet within said reconveying means; and means for preventing the sheets on which an image is formed from being fed to the reconveying means, and for delivering the sheets to the outside of the image forming apparatus, when said detecting means detects trouble or a malfunction in the feeding of the sheet in said reconveying means during said multiple or said both-side image formation.

2. The apparatus according to claim 1, wherein said reconveying means comprises a stack section for stacking the sheets, first conveying means for conveying the separated sheets to said stack section, and second conveying means for conveying the sheets stacked in said stack section to said main conveying means.

3. The apparatus according to claim 1, wherein said detecting means comprises means for detecting a sheet subject to delivery malfunction in said first conveying means.

4. The apparatus according to claim 3, wherein said detecting means is arranged near said stack section in said first conveying means.

5. The apparatus according to claim 3, wherein said first conveying means comprises means for exposing the interior section of a conveying path of the sheet.

6. The apparatus according to claim 13, wherein said first conveying means includes a first guide plate for guiding one surface of the sheet and a second guide plate for guiding the other surface of the sheet, said second guide plate being rotatable between a first position wherein it faces the first guide plate so as to guide the sheet and a second position for removing a jammed sheet, wherein it is spaced apart from the first guide.

7. The apparatus according to claim 6, wherein said second guide plate is disposed pivotably about one end thereof.

8. The apparatus according to claim 1, wherein said second conveying means comprises means for turning over each sheet.

* * * * *